US011898432B2

(12) United States Patent
Whitmore et al.

(10) Patent No.: US 11,898,432 B2
(45) Date of Patent: Feb. 13, 2024

(54) REAL TIME SURVEYING WHILE DRILLING IN A ROLL-STABILIZED HOUSING

(71) Applicant: Schlumberger Technology Corporation, Sugar Land, TX (US)

(72) Inventors: Andrew Whitmore, Stonehouse (GB); Abdiwahid Alasow, Stonehouse (GB); Edward Richards, Stonehouse (GB); Darren Lee Aklestad, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 177 days.

(21) Appl. No.: 17/628,583

(22) PCT Filed: Jul. 22, 2020

(86) PCT No.: PCT/US2020/042998
§ 371 (c)(1),
(2) Date: Jan. 20, 2022

(87) PCT Pub. No.: WO2021/016309
PCT Pub. Date: Jan. 28, 2021

(65) Prior Publication Data

US 2022/0251938 A1 Aug. 11, 2022

Related U.S. Application Data

(60) Provisional application No. 63/010,774, filed on Apr. 16, 2020, provisional application No. 62/877,907, filed on Jul. 24, 2019.

(51) Int. Cl.
*E21B 44/00* (2006.01)
*E21B 47/0228* (2012.01)

(52) U.S. Cl.
CPC ..... *E21B 44/00* (2013.01); *E21B 47/0228* (2020.05)

(58) Field of Classification Search
CPC ..... E21B 44/00; E21B 47/0228; E21B 7/06
See application file for complete search history.

(56) References Cited

U.S. PATENT DOCUMENTS 5,842,149 A * 11/1998 Harrell ..... E21B 44/02 702/9
6,021,377 A * 2/2000 Dubinsky ..... E21B 44/00 702/9

(Continued)

OTHER PUBLICATIONS

International Search Report and Written Opinion in International Patent application PCT/US2020/042998, dated Oct. 15, 2020, 14 pages.

(Continued)

*Primary Examiner* — Steven A MacDonald

(57) ABSTRACT

A method for drilling a subterranean wellbore includes rotating a drill string in the wellbore to drill. The drill string includes a roll-stabilized housing deployed in a drill collar and survey sensors deployed in the roll-stabilized housing. Sensor measurements are acquired while the drill string is rotating. High bandwidth accelerometer measurements may be obtained by combining triaxial accelerometer measurements and gyroscopic sensor measurements. Survey parameters, including a wellbore azimuth, may be computed from the high bandwidth accelerometer measurements. Triaxial magnetometer measurements may be processed to compute an eddy current induced wellbore azimuth error which may be removed from a previously computed wellbore azimuth to obtain a corrected wellbore azimuth.

20 Claims, 6 Drawing Sheets

(56) References Cited

U.S. PATENT DOCUMENTS

| | | | | |
|---|---|---|---|---|
| 6,206,108 | B1 * | 3/2001 | MacDonald | E21B 44/005 175/45 |
| 8,200,436 | B2 | 6/2012 | Sato et al. | |
| 8,280,638 | B2 | 10/2012 | Brooks | |
| 8,590,636 | B2 | 11/2013 | Menger | |
| 9,435,649 | B2 | 9/2016 | Sato et al. | |
| 9,593,949 | B2 | 3/2017 | Neul et al. | |
| 2001/0041963 | A1 | 11/2001 | Estes et al. | |
| 2004/0079526 | A1 * | 4/2004 | Cairns | E21B 44/00 166/255.2 |
| 2004/0222019 | A1 * | 11/2004 | Estes | E21B 44/00 175/45 |
| 2016/0177704 | A1 | 6/2016 | Van Steenwyk | |
| 2017/0321485 | A1 * | 11/2017 | Bhosle | G06K 19/0723 |
| 2018/0066513 | A1 * | 3/2018 | Sugiura | E21B 7/06 |
| 2018/0223646 | A1 | 8/2018 | Zhang et al. | |
| 2019/0024500 | A1 | 1/2019 | Deverse et al. | |
| 2019/0169974 | A1 | 6/2019 | Melo Uribe et al. | |

OTHER PUBLICATIONS

Brooks et al., "Practical Application of a Multiple-Survey Magnetic Correction Algorithm", SPE 49060, New Orleans, Louisiana, Sep. 17-30, 1998, 8 pages.

Chia et al., "MWD Survey Accuracy Improvements Using Multistation Analysis", IADC/SPE 87977, Kuala Lumpur, Malaysia, Sep. 13-15, 2004, 7 pages.

* cited by examiner

REAL TIME SURVEYING WHILE DRILLING IN A ROLL-STABILIZED HOUSING

CROSS REFERENCE TO RELATED APPLICATIONS

This application is the U.S. National Phase of International Patent Application No. PCT/US2020/042998, filed Jul. 22, 2020, and entitled "Real Time Surveying while Drilling in a Roll-Stabilized Housing", which claims the benefit of U.S. Provisional application No. 63/010,774 entitled "Real Time Surveying While Drilling In A Roll-Stabilized Housing", filed Apr. 16, 2020 and of U.S. Provisional application No. 62/877,907 entitled "Real Time Surveying While Drilling In A Roll-Stabilized Housing", filed Jul. 24, 2019, the disclosure of each of which is incorporated herein by reference.

FIELD

Disclosed embodiments relate generally to surveying while drilling methods in rotary systems employing a roll-stabilized housing and more particularly to surveying methods for obtaining wellbore azimuth while drilling.

BACKGROUND

In conventional drilling and measurement while drilling (MWD) operations, wellbore inclination and wellbore azimuth are determined at a discrete number of longitudinal points along the axis of the wellbore. These discrete measurements may be assembled into a survey of the well and used to calculate a three-dimensional well path (e.g., using the minimum curvature or other curvature assumptions). Wellbore inclination is commonly derived (computed) from tri-axial accelerometer measurements of the earth's gravitational field. Wellbore azimuth (also commonly referred to as magnetic azimuth) is commonly derived from a combination of tri-axial accelerometer and tri-axial magnetometer measurements of the earth's gravitational and magnetic fields.

Static surveying measurements are made after drilling has temporarily stopped (e.g., when a new length of drill pipe is added to the drill string) and the drill bit is lifted off bottom. Such static measurements are commonly made at measured depth intervals ranging from about 30 to about 90 feet. While these static surveying measurements may, in certain operations, be sufficient to obtain a well path of suitable accuracy, such static surveying measurements are time consuming as they require drilling to temporarily stop and the drill string to be lifted off the bottom of the wellbore.

SUMMARY

A method for drilling a subterranean wellbore is disclosed. In some embodiments, the method includes rotating a drill string in the wellbore to drill. The drill string includes a drill collar, a drill bit, a roll-stabilized housing deployed in the drill collar, and a triaxial accelerometer set, a triaxial magnetometer set, and at least one gyroscopic sensor deployed in the roll-stabilized housing. Sensor measurements are acquired while the drill string is rotating (e.g., drilling) and the triaxial accelerometer measurements and the gyroscopic sensor measurements are combined to obtain high bandwidth accelerometer measurements. The high bandwidth accelerometer measurements and the triaxial magnetometer measurements are then processed to compute at least a wellbore azimuth of the subterranean wellbore while drilling.

In another embodiment, a method for drilling a subterranean wellbore includes rotating a drill string in the wellbore to drill. The drill string includes a drill collar, a drill bit, a roll-stabilized housing deployed in the drill collar, and a triaxial accelerometer set and a triaxial magnetometer set deployed in the roll-stabilized housing. Sensor measurements are acquired while the drill string is rotating (e.g., drilling) and processed to compute a wellbore azimuth of the subterranean wellbore while drilling. The triaxial magnetometer measurements are further processed to compute an eddy current induced wellbore azimuth error which is then removed from the previously computed wellbore azimuth to obtain a corrected wellbore azimuth.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

A method for drilling a subterranean wellbore is disclosed. In some embodiments, the method includes rotating a drill string in the subterranean wellbore to drill the wellbore. The drill string includes a drill collar, a drill bit, and survey sensors (e.g., a triaxial accelerometer set and a triaxial magnetometer set) deployed therein. In the disclosed embodiments, the triaxial accelerometer set and the triaxial magnetometer set are deployed in a substantially geo-stationary roll-stabilized housing in the drill collar and are configured to make corresponding accelerometer and magnetometer measurements while drilling (while the drill string is rotating in the wellbore). These measurements may be synchronized, for example via combining the accelerometer measurements with gyroscopic sensor measurements, to obtain accelerometer and magnetometer measurements having a common bandwidth and then further processed to compute at least an azimuth of the subterranean wellbore while drilling.

Some embodiments as disclosed herein may provide various technical advantages and improvements over the prior art. For example, in some embodiments, an improved method and system for drilling a subterranean wellbore includes computing survey parameters such as wellbore inclination and wellbore azimuth (and optionally further including dip angle and magnetic toolface) in real time while drilling the well (e.g., several measurements per minute or several measurements per foot of measured depth of the wellbore). Some embodiments may therefore provide a much higher density of survey measurements along the wellbore profile than are available via conventional static surveying methods. This higher measurement density may then enable a more accurate wellbore path to be determined. Improving the timeliness and density of wellbore surveys may further advantageously improve the speed and effectiveness of wellbore steering activities, such as anti-collision decision making.

Moreover, some embodiments provide accelerometer and magnetometer measurements having a common bandwidth and thereby advantageously improve the accuracy of the computed survey parameters as compared to prior art dynamic surveying methods. In some embodiments, the accuracy of the computed survey parameters may be sufficiently high that there is no longer a need to make conventional static surveying measurements (or such that the number of required static surveys may be reduced). This can greatly simplify wellbore drilling operations and significantly reduce the time and expense required to drill the well. Moreover, eliminating or reducing the number of required static surveys may improve steerability, for example, via reducing wellbore washout in soft formations. Such washout can be caused by drilling fluid circulation when the drill string is stationary and is known to cause subsequent steering problems.

Figure 1:
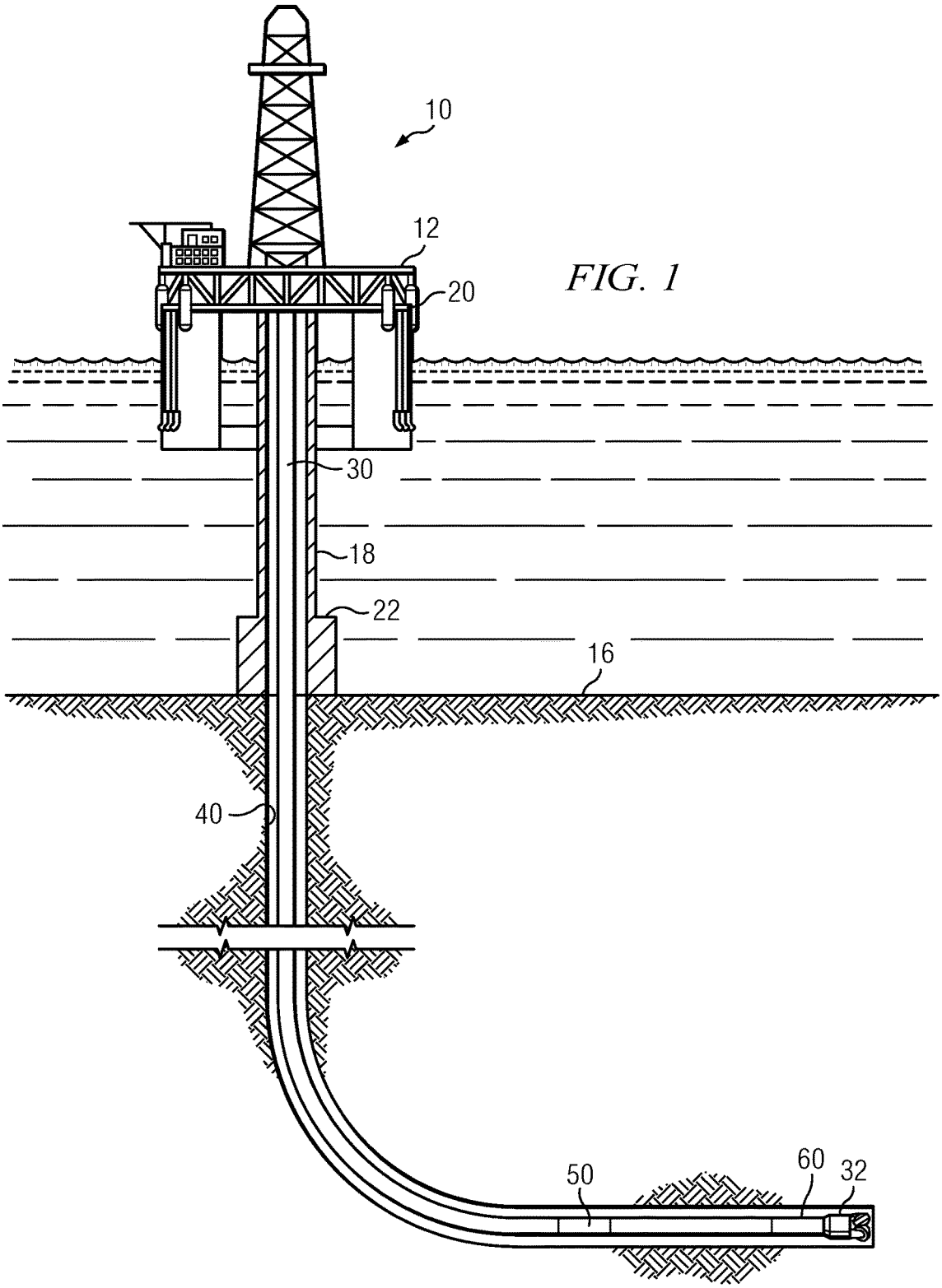
FIG. 1 depicts a drilling rig on which disclosed embodiments may be utilized.

FIG. 1 depicts a drilling rig 10 suitable for implementing various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a rotary steerable tool 60. Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

Figure 2:
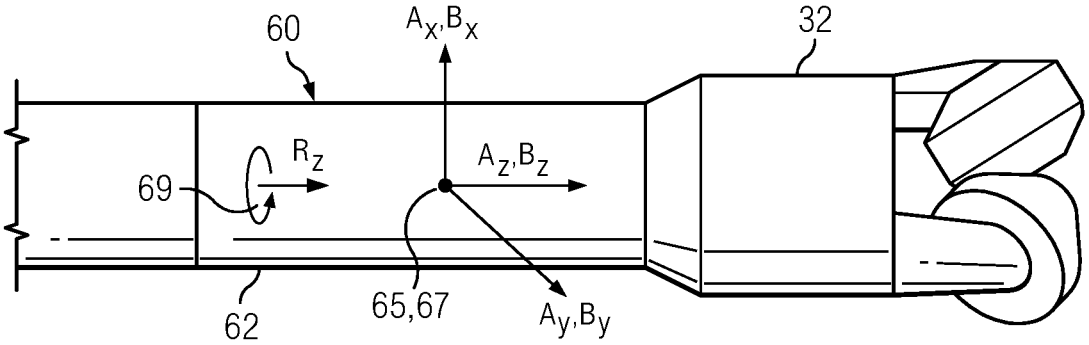
FIG. 2 depicts a lower BHA portion of the drill string shown on FIG. 1.

FIG. 2 depicts the lower BHA portion of drill string 30, including drill bit 32 and rotary steerable tool 60. The rotary steerable tool may include substantially any suitable steering tool including a roll-stabilized controller (or control unit) deployed in a roll-stabilized housing or an otherwise substantially non-rotating housing. By roll-stabilized it is meant that the sensor housing rotates independently from the drill string, and in some embodiments, it may be substantially non-rotating with the respect to the wellbore in certain operations (or may rotate very slowly in comparison to the drill string). For example, various PowerDrive rotary steerable systems (available from Schlumberger) include a drill collar that is intended to fully rotate with the drill string and an internal roll-stabilized control unit that is intended (at certain times) to remain substantially rotationally geostationary (i.e., rotationally stable with respect to the tool axis, the tool axis attitude being defined with respect to the wellbore reference frame). It will be understood that such rotary steerable systems may employ alternating active steering (or bias) and neutral phases to drill curved sections of a wellbore and primarily utilized the neutral phase to drill straight ahead. During the active phase the roll-stabilized housing 70 tends to be rotationally geostationary (or rotate very slowly). During the neutral phase the roll-stabilized housing 70 tends to rotate with respect to the wellbore (while remaining rotationally independent from the drill string) and can rotate at speeds near the drill string rotation rate. The disclosed embodiments advantageously enable dynamic surveying measurements to be made and corrected while the roll-stabilized housing is rotating or non-rotating (e.g., while drilling in both the active (bias) and neutral phases). It will of course be understood that control of the roll-stabilized housing is not limited to active steering and neutral phases and the roll-stabilized housing may rotate at any desired speed during active phases, neutral phases, or at any time.

Other rotary steerable systems, e.g., including the PathMaker rotary steerable system (available from PathFinder a Schlumberger Company), the AutoTrak rotary steerable system (available from Baker Hughes), and the GeoPilot rotary steerable system (available from Sperry Drilling Services), include a substantially non-rotating (or very slowly rotating) outer housing employing blades that engage the borehole wall.

While FIG. 2 depicts a rotary steerable tool 60, it will be understood that the disclosed embodiments are not limited to the use of a rotary steerable tool. Moreover, while navigation sensors 65, 67, and 69 (e.g., accelerometers, magnetometers, and gyroscopic sensors) may be deployed and the corresponding sensor measurements processed in a rotary steerable tool (e.g., as depicted on FIG. 2), they may also be located in a roll-stabilized housing (e.g., a housing that rotates independently of the drill string as described above) located substantially anywhere in the drill string. For example, with reference again to FIG. 1, drill string 30 may include a measurement while drilling tool 50 including corresponding sensors 65, 67, and 69 deployed in a roll-stabilized housing. The MWD tool may include, for example, a PowerDrive Control Unit or other suitable device, employing substantially any suitable rotational control scheme (depending on particular operational demands) and having a rotation rate with respect to the wellbore in a range from about 0 (geostationary) to about the rotation rate of the drill string. As is known to those of ordinary skill in the art, such MWD tools 50 may further include a mud pulse telemetry transmitter or other telemetry system, an alternator for generating electrical power, and an electronic controller. It will thus be appreciated that the disclosed embodiments are not limited to any specific deployment location of the navigational sensors in the drill string.

With continued reference to FIGS. 1 and 2, the depicted rotary steerable tool 60 and/or MWD tool 50 include(s) tri-axial accelerometer 65 and tri-axial magnetometer 67 navigation sensor sets and an inertial sensor 69 (such as a gyroscopic sensor). These navigation sensors may include substantially any suitable available devices. Suitable accelerometers for use in sensor set 65 may include, for example, conventional Q-flex types accelerometers or micro-electro-mechanical systems (MEMS) solid-state accelerometers. Suitable magnetic field sensors for use in sensor set 67 may include, for example, conventional ring core flux gate magnetometers or magnetoresistive sensors. Suitable gyroscopic sensors may include any of the variety of types of gyros used downhole, for example, including a rate gyro configured and deployed to measure a rotational velocity about a longitudinal axis of the drill string (a rate of change of toolface angle with time). MEMS type gyros may be advantageous in that they are inexpensive and have no moving parts.

FIG. 2 further includes a diagrammatic representation of the tri-axial accelerometer and magnetometer sensor sets 65 and 67. By tri-axial it is meant that each sensor set includes three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the tool axis (and therefore the wellbore axis) as indicated (although disclosed embodiments are not limited by such conventions). Each of the accelerometer and magnetometer sets may therefore be considered as determining a plane (the x and y-axes) and a pole (the z-axis along the axis of the BHA).

FIG. 2 still further includes a diagrammatic representation of the gyroscopic sensor 69. The gyroscopic sensor 69 includes at least one gyroscope configured to measure a rotation rate about the z-axis (i.e., about the longitudinal axis of the drill string) and is therefore designated as $R_z$. Substantially any suitable gyroscopic sensor configured to measure a rotation rate about an axis may be utilized. Such sensors may include, for example, single axis integrating gyros, dual axis rate gyros, optical gyros including fiber optic gyros, and MEMS gyros. One example of a suitable gyroscopic sensor is disclosed in U.S. Pat. No. 9,593,949. Moreover, it will be understood that the disclosed embodiments are not limited to sensors including only a single gyroscopic sensor. Any suitable number of gyroscopic sensors may be employed, for example, including one, two, three, or more (e.g., including a cross-axial gyroscope or a triaxial gyroscopic sensor set).

By convention, the gravitational field is taken to be positive pointing downward (i.e., toward the center of the earth) while the magnetic field is taken to be positive pointing towards magnetic north. Moreover, also by convention, the y-axis is taken to be the toolface reference axis (i.e., gravity toolface GTF equals zero when the y-axis is uppermost and magnetic toolface MTF equals zero when the y-axis is pointing towards the projection of magnetic north in the xy plane). The disclosed method embodiments are of course not limited to the above described conventions for defining wellbore coordinates. These conventions can affect the form of certain of the mathematical equations that follow in this disclosure. Those of ordinary skill in the art will be readily able to utilize other conventions and derive equivalent mathematical equations.

Figure 3B:
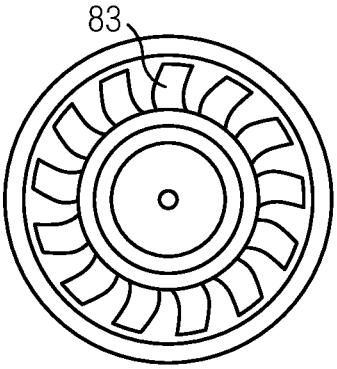
FIGS. 3A and 3B (collectively FIG. 3) depict a schematic representation of a roll-stabilized housing deployed in a downhole tool.
Figure 3A:
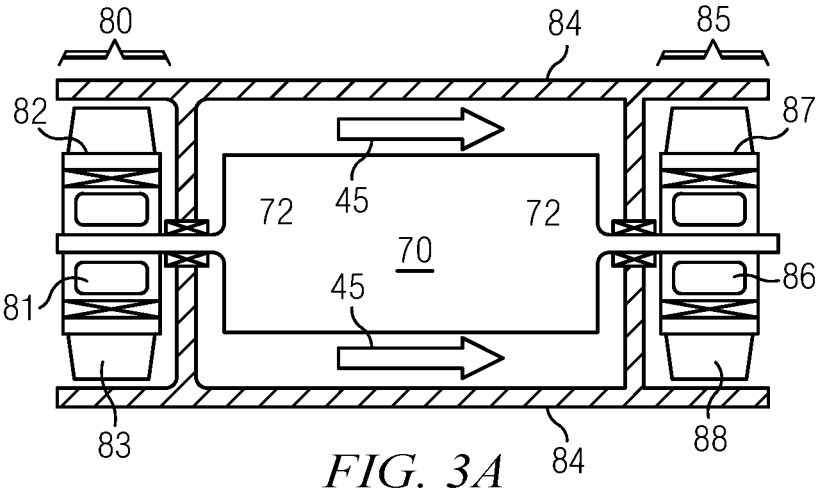

FIGS. 3A and 3B (collectively FIG. 3) depict a schematic representation of one example of a roll-stabilized housing 70 deployed in a rotary steerable tool 60 (FIG. 2). It will be understood that this is merely an example and that the disclosed method embodiments are not limited to any particular roll-stabilizing mechanism or configuration. In the depicted example, the roll-stabilized housing 70 is mounted on bearings 72 such that it is rotationally decoupled from (able to rotate independently with respect to) tool collar 84. In the depicted embodiment, first and second alternators 80, 85 (e.g., of the permanent magnet synchronous motor type) are separately mounted on opposing axial ends of the roll-stabilized housing 70. The corresponding stator windings 81, 86 are mechanically continuous with the roll-stabilized housing 70 (and are therefore rotationally coupled with the roll-stabilized housing). Corresponding rotors including permanent magnets 82, 87 are configured to rotate independently of both the roll-stabilized housing 70 and the tool collar 84. Impeller blades 83, 88 are mechanically contiguous with the corresponding rotors and span the annular clearance between the housing 70 and the tool collar 84 such that they rotate, for example, in opposite directions with the flow of drilling fluid 45 through the tool.

In the depicted example, the rotational orientation of the housing 70 may be controlled by the co-action of the alternators 80 and 85 in combination with feedback provided by the sensors (e.g., accelerometers and/or magnetometers) deployed in the housing. The impellers 83 and 88 being configured to rotate in opposite directions apply corresponding opposite torques to the housing 70. The amount of electrical load on the torque generators 80 and 85 may be changed in response to feedback from the at least one of the sensors 65 and 67 to vary the applied torques and thereby control the orientation of the housing. When used in a rotary steerable system, the control unit may have an output shaft that is rigidly connected to a rotary valve. The rotary valve directs fluid from the flow to an actuator in a steering bias unit, which then acts to steer the tool (e.g., by acting on the borehole wall or by acting on a bit shaft). Thus by controlling the orientation of the control unit, the orientation of the rotary valve is controlled, thereby providing steering control.

Figure 4:
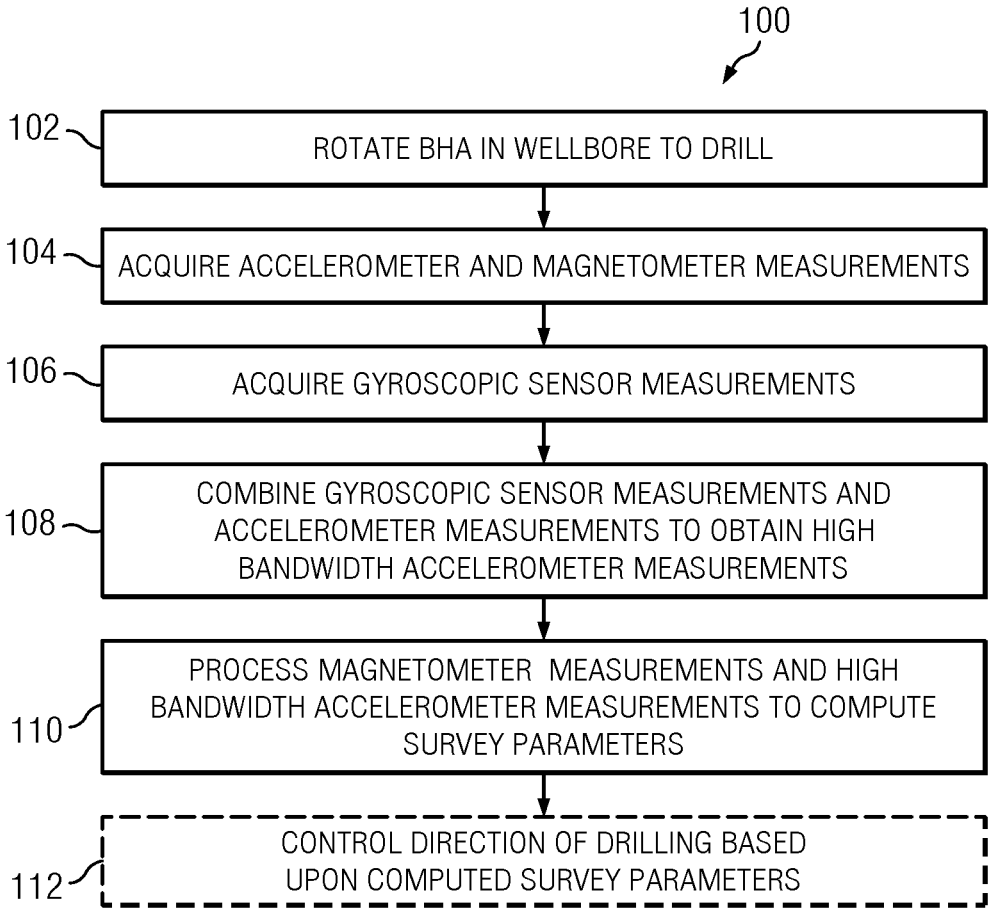
FIG. 4 depicts a flow chart of a method for drilling a subterranean wellbore.

FIG. 4 depicts a flow chart of embodiments 100 for drilling a subterranean wellbore. A bottom hole assembly (e.g., as depicted on FIGS. 1 and 2) is rotated in the wellbore at 102 to drill the well. The bottom hole assembly includes triaxial accelerometers, triaxial magnetometers, and at least one gyroscopic sensor deployed in a roll-stabilized housing. Triaxial accelerometer and triaxial magnetometer measurements are made at 104 while drilling in 102 (i.e., while rotating the bottom hole assembly in the wellbore to drill the well). Gyroscopic sensor measurements are also made while drilling the well at 106. The gyroscopic sensor measurements and the cross-axial components of the triaxial accelerometer measurements are combined at 108 to obtain high bandwidth cross-axial accelerometer measurements. For example, the gyroscopic sensor measurement $R_z$ (the rotation rate about the z-axis) is combined with the cross-axial accelerometer measurements $A_x$ and $A_y$ to obtain high bandwidth cross-axial accelerometer measurements $A_x'$ and $A_y'$. The triaxial magnetometer measurements $B_x$, $B_y$, and $B_z$, the axial component of the triaxial accelerometer measurements $A_z$, and the high bandwidth cross-axial accelerometer measurements $A_x'$ and $A_y'$ may then be processed at 110 to compute various survey parameters including the wellbore azimuth. These parameters may then optionally be used for wellbore position and trajectory control at 112 while drilling continues in 102. For example, the direction of drilling in 102 may be adjusted in response to the survey parameters (e.g., by adjusting the position of blades or other actuating components in a rotary steerable tool) to continue drilling along a predetermined path.

In some embodiments, there may a phase delay between the accelerometer and magnetometer data streams that can result in significant errors in computed survey parameters. Wellbore azimuth and dip angle are particularly susceptible to this phase delay since they are computed using a combination of accelerometer and magnetometer measurements. The phase delay may be caused (at least in part) by bandwidth mismatch between the magnetometer and accelerometer measurements. As disclosed herein, gyroscopic sensor measurements may be processed in combination with the accelerometer measurements to provide high bandwidth accelerometer measurements that may be bandwidth matched with the magnetometer measurements and thereby significantly reduce or eliminate the phase delay.

Accelerometer measurements are highly susceptible to external forces (e.g., vibration and shocks) and therefore tend to be heavily low pass filtered (or averaged). This filtering severely limits the bandwidth of the corresponding accelerometer measurements. Gyroscopic sensor measurements are not generally susceptible to external forces and can be used to make high bandwidth (frequency) toolface measurements by integrating the angular velocity (the rotation rate) over time. However, owing to such mathematical integration, gyroscopic toolface measurements have a tendency to drift over time. Combining the gyroscopic measurements with the accelerometer measurements may result in a combined measurement having attributes of both measurements (e.g., the best attributes of both measurements). At high frequencies (short times), gyroscopic data may be favored since the gyroscopes are not susceptible to external forces while at low frequencies (longer times) the accelerometer data is favored since it does not drift.

Figure 5:
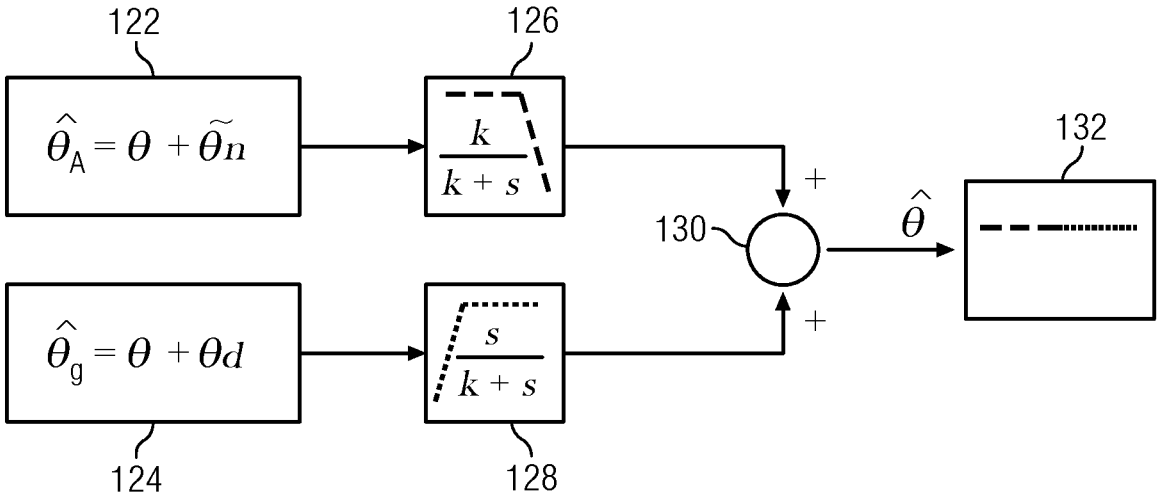
FIG. 5 depicts a combination of the gyroscopic sensor measurements and the accelerometer measurements to obtain high bandwidth accelerometer measurements.

FIG. 5 depicts one example of the combination (or fusion) of the gyroscopic sensor measurements and the accelerometer measurements. The accelerometer measurements are processed to obtain an accelerometer based toolface angle measurement $\hat{\theta}_A$ (designated as $\hat{\theta}_A=\theta+\tilde{\theta}n$) at 122 in which $\theta$ represents the actual toolface angle and $\tilde{\theta}n$ represents the high frequency noise. For example, a gravity toolface angle GTF may be computed using the equation $\hat{\theta}_A$=GTF=arctan $(A_x/A_y)$. The gyroscopic measurements are processed (e.g., via numerical integration as noted above) to obtain a gyroscope based toolface angle measurement $\hat{\theta}_g$ (designated as $\hat{\theta}_g=\theta+\theta d$) at 124 in which $\theta$ represents the actual toolface angle and $\theta d$ represents the low frequency drift due to the integration. The toolface angle measurement obtained at 122 is low pass filtered at 126 while the toolface angle measurement obtained at 124 is high pass filtered at 128. These filtered measurements are combined (e.g., summed) at 130 to obtain a high bandwidth (or substantially full spectrum) combined (or fused) toolface angle measurement $\hat{\theta}$ as indicated at 132.

Based on the depiction in FIG. 5, the high bandwidth combined toolface angle measurement $\hat{\theta}$ may be expressed as a mathematical sum of the accelerometer based toolface angle and the gyroscope based toolface angle, for example, as follows:

$$\hat{\theta}=\hat{\theta}_A+\hat{\theta}_y \tag{1a}$$

Combining the low pass filtered accelerometer based toolface angle measurements and the high pass filtered gyroscope based toolface angle measurements gives a high bandwidth (full spectrum) toolface angle measurement in which the high frequency noise $\tilde{\theta}n$ and the drift $\theta'd$ are e.g., reduced or substantially eliminated. This may be expressed mathematically, for example, as follows:

$$\hat{\theta}=\frac{s}{k+s}\cdot\theta+\frac{k}{k+s}\cdot\theta+\frac{s}{k+s}\cdot\theta d+\frac{k}{k+s}\cdot\tilde{\theta}n=\theta+\frac{\theta' d}{k+s}+\frac{k}{k+s}\cdot\tilde{\theta}n \tag{1b}$$

where the drift $\theta'd$ is bounded and in the steady state and settles to $\theta'd/k$ and the high frequency noise $\tilde{\theta}n$ is low pass filtered and attenuated. High bandwidth accelerometer measurements $A_x'$, $A_y'$, and $A_z'$ may be computed from the high bandwidth combined toolface angle measurement $\hat{\theta}$, for example, as follows:

$$A_x'=-\sin(\text{Inc})\cdot\cos(\hat{\theta})$$

$$A_y'=\sin(\text{Inc})\cdot\sin(\hat{\theta})$$

$$A_z'=\cos(\text{Inc}) \tag{2}$$

where Inc represents the wellbore inclination. The wellbore inclination may be obtained, for example, from a prior static survey or from the triaxial accelerometer measurements made in 104. The high bandwidth accelerometer measurements $A_x'$, $A_y'$, and $A_z'$ may be advantageously bandwidth matched with the magnetometer measurements such that an improved wellbore azimuth may be computed from the high bandwidth accelerometer measurements and the magnetometer measurements.

The wellbore azimuth Azi may be computed from the high bandwidth accelerometer measurements $A_x'$, $A_y'$, and $A_z'$ and the magnetometer measurements $B_x$, $B_y$, and $B_z$, for example, as follows:

$$Azi=\arctan\left(\frac{(A_x'B_y-A_y'B_x)\cdot\sqrt{A_x'^2+A_y'^2+A_z'^2}}{B_z(A_x'^2+A_y'^2)-A_z'(A_x'B_x-A_y'B_y)}\right) \tag{3}$$

Figure 6:
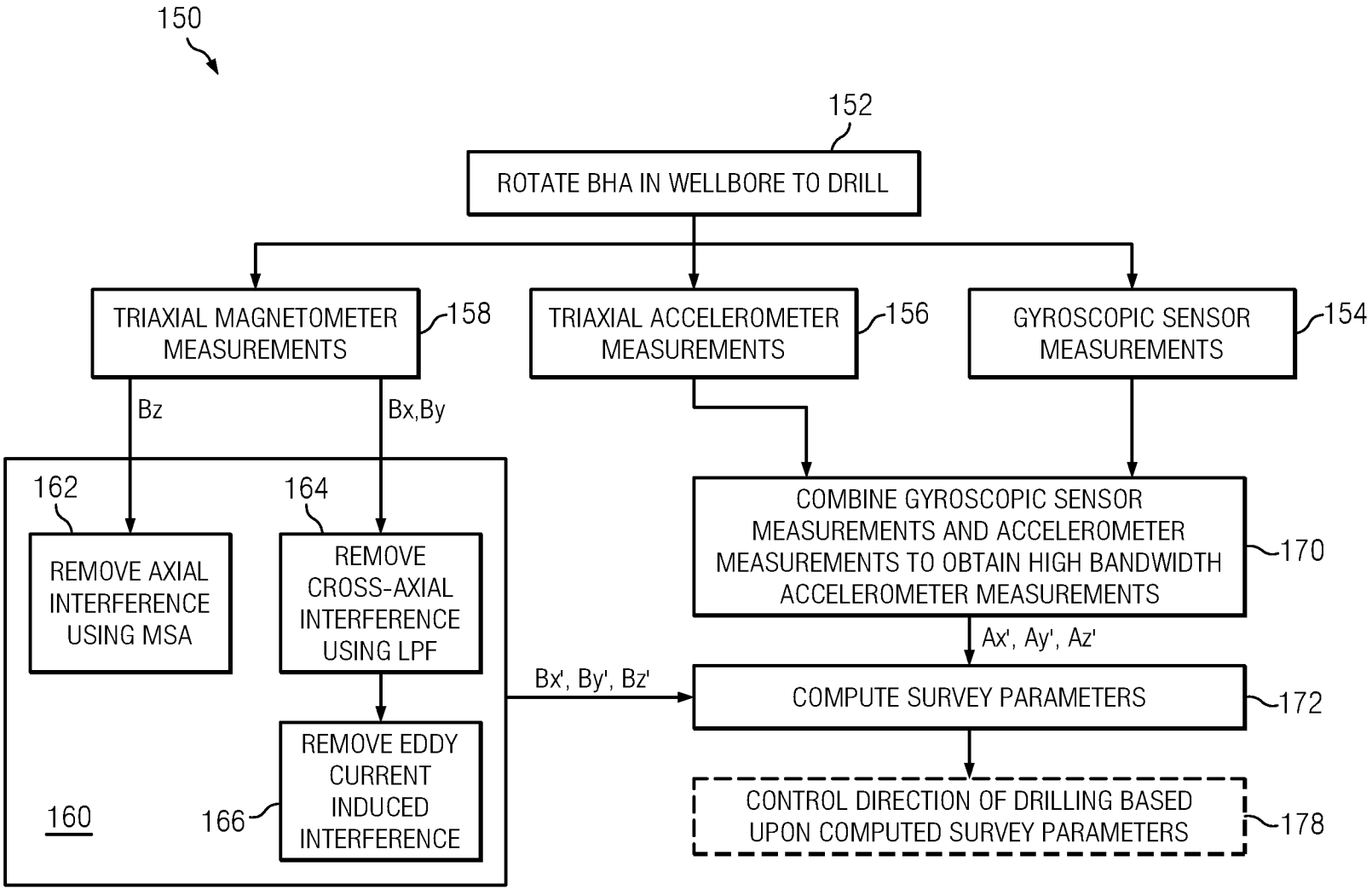
FIG. 6 depicts a flow chart of a method for drilling a subterranean wellbore.

FIG. 6 depicts a flow chart of embodiments 150 for drilling a subterranean wellbore. A bottom hole assembly (e.g., as depicted on FIGS. 1 and 2) is rotated in the wellbore at 152 to drill the well. The bottom hole assembly includes accelerometers, magnetometers, and at least one gyroscopic sensor deployed in a roll-stabilized housing as described above with respect to method 100 (FIG. 4). At least one gyroscopic sensor measurement is made at 154. Triaxial accelerometer and triaxial magnetometer measurements are made at 156 and 158 while drilling in 152 (i.e., while rotating the bottom hole assembly in the wellbore to drill the well).

It will be understood that the magnetometer measurements can be corrupted by magnetic interference emanating from various elements in the drill string, e.g., including the drill bit, drill collar, mud motors, stabilizers, rotary steerable steering units, and the like. The triaxial magnetometer measurements (or certain components thereof) may be processed at 160 to remove or reduce such magnetic interference. For example, axial magnetic interference may optionally be removed from the axial magnetic field measurement $B_z$ using multi-station analysis (MSA) at 162 to obtain a corrected axial magnetic field measurement $B_z'$. Cross-axial magnetic interference may optionally be removed from the cross-axial magnetic field measurements $B_x$ and $B_y$, for example, via filtering at 164. Rotation of the drill collar with respect to the roll-stabilized housing during drilling results in a time varying magnetic interference having a characteristic frequency (e.g., in a range from about 1 to about 4 Hz) that can be removed via filtering.

With continued reference to FIG. 6, rotation of an electrically conductive drill collar in the Earth's magnetic field can induce eddy currents in the drill collar which in turn may generate appreciable magnetic interference. The filtered cross-axial magnetic field measurements $B_x$ and $B_y$ may therefore optionally be further processed at 166 to remove (or reduce) eddy current induced magnetic interference to obtain corrected cross-axial magnetic field measurements $B_x'$ and $B_y'$.

As described above with respect to FIGS. 4 and 5, the gyroscopic sensor measurements and at least the cross-axial components of the triaxial accelerometer measurements may be combined at 170 to obtain high bandwidth cross-axial accelerometer measurements. The high bandwidth accelerometer measurements and the corrected magnetometer measurements may be processed at 172 to compute various survey parameters including the wellbore azimuth. These parameters may then optionally be used and further processed for wellbore position and trajectory control at 174 while drilling continues in 152. For example, as described above, the direction of drilling in 152 may be adjusted in response to the computed survey parameters (e.g., by adjusting the position of blades or other actuating components in a rotary steerable tool) to continue drilling along a predetermined path.

As noted above, axial magnetic interference may be removed from the axial magnetic field measurement, for example, using multi-station analysis at 164. Such multi-station analysis involves processing accelerometer and magnetometer measurements taken at 156 and 158 at a plurality of locations along the length of the wellbore (e.g., at multiple static survey stations) to determine axial magnetic interference (or axial and cross-axial interference). The magnetic interference may then be subtracted from the axial (or axial and cross-axial) magnetometer measurements to obtain corrected axial magnetometer measurements. Suitable multi-station analysis techniques are disclosed, for example, in U.S. Pat. No. 8,280,638 as well as in *Brooks et al, Practical Application of a Multiple-Survey Magnetic Correction Algorithm, SPE* 49060, 1998 and *Chia and Lima, MWD Survey Accuracy Improvements Using Multistation Analysis, IADC/SPE* 87977, 2004, all of which are incorporated herein by reference in their entireties.

As noted above, rotation of an electrically conductive drill collar in the Earth's magnetic field can induce eddy currents in the drill collar which in turn may generate appreciable magnetic interference. This magnetic interference can in turn impart errors into survey parameters computed from the magnetometer measurements (e.g., wellbore azimuth and magnetic dip). The error may be compensated at 166 by removing eddy current induced interference from the cross-axial magnetometer measurements. For example, the eddy current induced interference may be determined based upon the rotation rate of the drill collar and the attitude (inclination and azimuth) of the wellbore and then subtracted from the filtered cross-axial magnetometer measurements.

Figure 7:
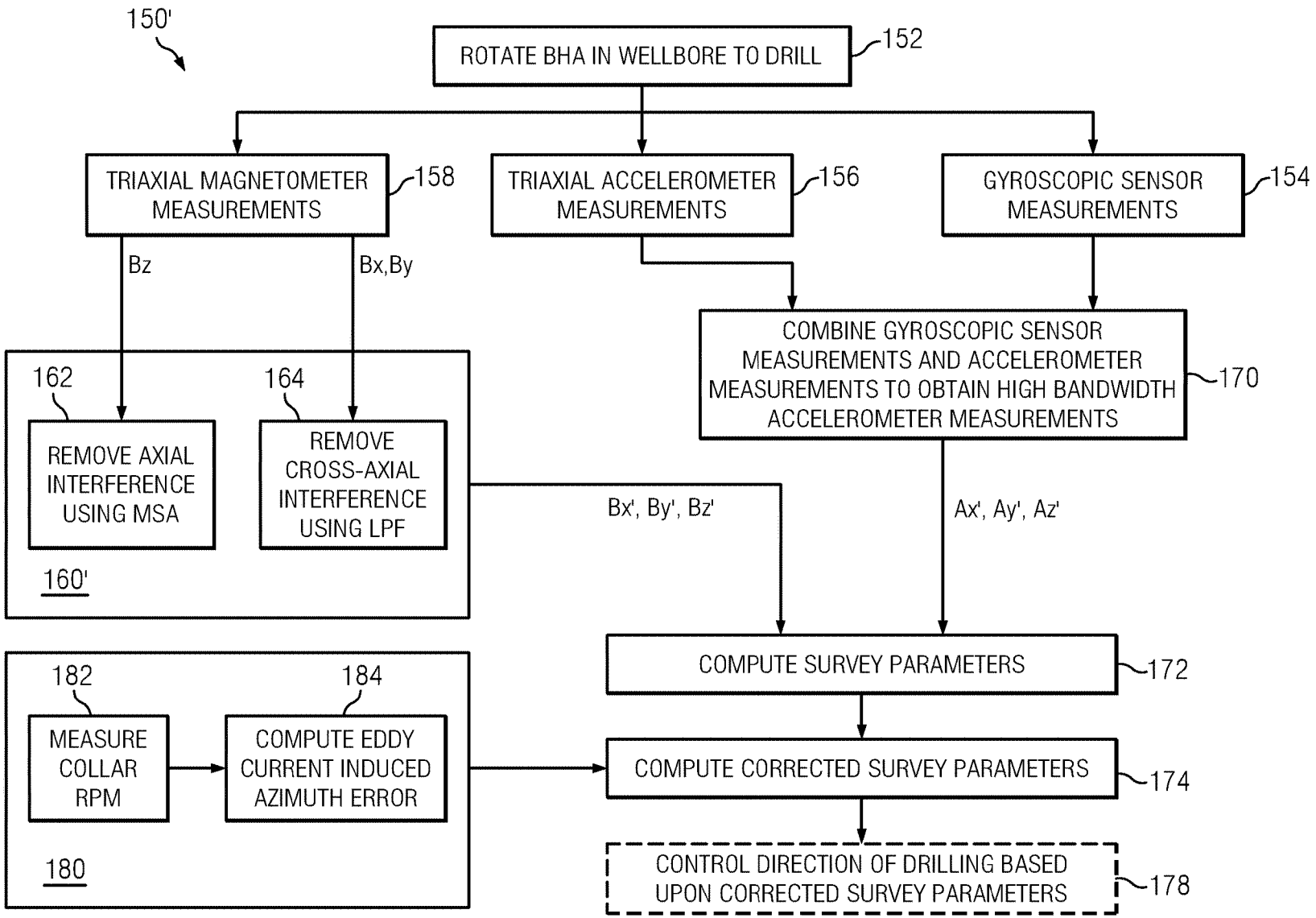
FIG. 7 depicts a flow chart of a method for drilling a subterranean wellbore.

FIG. 7 depicts embodiments 150' in which the magnetic interference is removed from the magnetometer measurements at 160' (e.g., at 162 and 164 as described above with respect to FIG. 6). The high bandwidth accelerometer measurements and the corrected magnetometer measurements are used to compute survey parameters at 172 while drilling in 152 as also described above in FIG. 6. An eddy current induced azimuth error is computed at 180. Corrected survey parameters may be computed at 174, for example, via removing (subtracting) the azimuth error from the wellbore azimuth computed in 172. In the depicted embodiment, the collar rotation rate is measured at 182 (e.g., using collar deployed radial magnetometers or other known methods) and processed to compute the eddy current induced azimuth error at 184.

Figure 8:
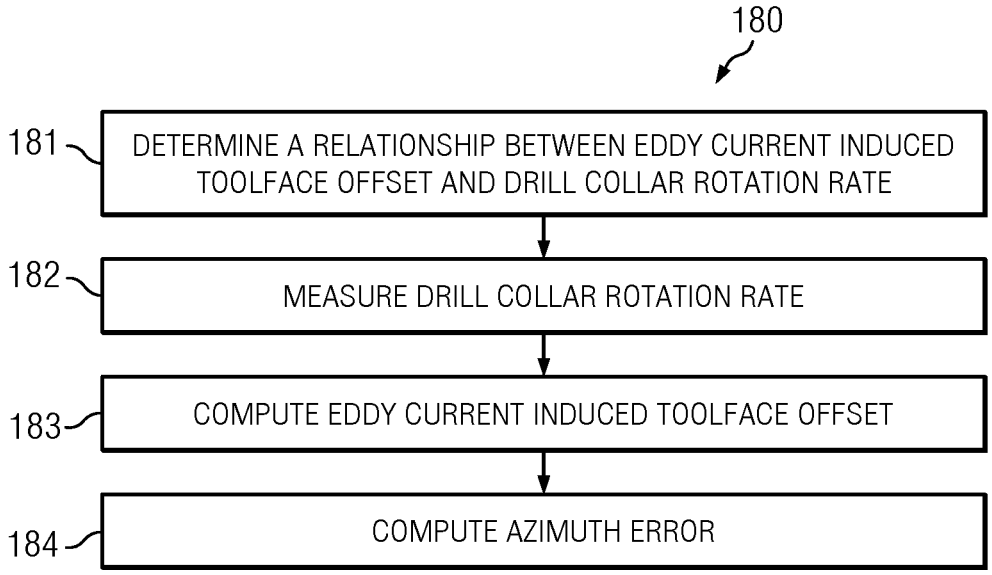
FIG. 8 depicts a flow chart of a method for computing an eddy current induced azimuth error in FIG. 7.

FIG. 8 depicts embodiments 180 for computing the eddy current induced azimuth error. A relationship is determined between eddy current induced toolface offset and drill collar rotation rate at 181. The drill collar rotation rate may be measured at 182 and processed in combination with the relationship determined in 181 to compute an eddy current induced toolface offset at 183. The eddy current induced toolface offset may be processed at 184 to compute an eddy current induced azimuth error.

The relationship between eddy current induced toolface offset and drill collar rotation rate may be determined, for example, by measuring the toolface offset at first and second drill collar rotation rates while drilling in 152. The eddy current induced toolface offset may be assumed to be substantially proportional to the drill collar rotation rate, for example, as in the following equation:

$$\alpha_{ECI}=k\cdot\mathrm{RPM} \tag{4}$$

where $\alpha_{ECI}$ represents the eddy current induced toolface offset, RPM represents the drill collar rotation rate, and k represents a proportionality constant. The proportionality constant k may be determined based on toolface offset measurements made at first and second rotation rates, for example, as indicated in the following equation $$k=\frac{\alpha_2-\alpha_1}{RPM_2-RPM_1} \tag{5}$$

where $\alpha_1$ and $\alpha_2$ represent toolface offset measurements made at the corresponding first and second drill collar rotation rates $RPM_1$ and $RPM_2$. In one example embodiment, the first drill collar rotation rate $RPM_1$ may be essentially zero and the corresponding toolface offset $\alpha_1$ may be computed, for example, based on static surveying measurements (although the disclosed embodiments are not limited in this regard). The drill collar may then be rotated after completion of the static survey (at $RPM_2$). Accelerometer and magnetometer measurements may be made while rotating and a corresponding toolface offset $\alpha_2$ computed. Subtraction of the static toolface offset from the rotating toolface offset yields the eddy current toolface offset at the collar rotation rate.

Toolface offset is the angular offset between the gravity (accelerometer based) toolface angle and the magnetic (magnetometer based) toolface angle and may be computed from the accelerometer and magnetometer measurements made in 156 and 158 and/or the corrected quantities obtained at 160, 160' and 170, for example as follows:

$$\alpha=\arctan\left(\frac{-A_x'}{-A_y'}\right)-\arctan\left(\frac{B_x'}{B_y'}\right) \tag{6}$$

The toolface offset $\alpha$ may also be computed from the following equation:

$$\alpha=\arctan\left(\frac{\sin A}{\sin I\tan D-\cos I\cos A}\right) \tag{7}$$

where A represents the wellbore azimuth, I represents the wellbore inclination, and D represents the dip angle of the wellbore. Differentiating Equation 7 with respect to wellbore azimuth (A) and taking the reciprocal yields the following equation which relates a change in azimuth (dA) to a corresponding change in toolface offset angle (dα):

$$\frac{dA}{d\alpha} = \frac{\tan(D)^2\sin(I)^2 - 2\cos(A)\tan(D)\cos(I)\sin(I) + \cos(A)^2\cos(I)^2 + \sin(A)^2}{\cos(A)\tan(D)\sin(I) - \cos(I)} \quad (8)$$

The eddy current induced azimuth error may be computed at 184, for example, via substituting $\alpha_{ECI}$ from Equation 4 into Equation 8 in place of dα and solving for the corresponding change in azimuth dA. This corresponding change in azimuth (the eddy current induced azimuth error) may then be added (or subtracted) to the wellbore azimuth computed at 172 to compute a corrected wellbore azimuth as described above with respect to FIG. 7.

Figure 9:
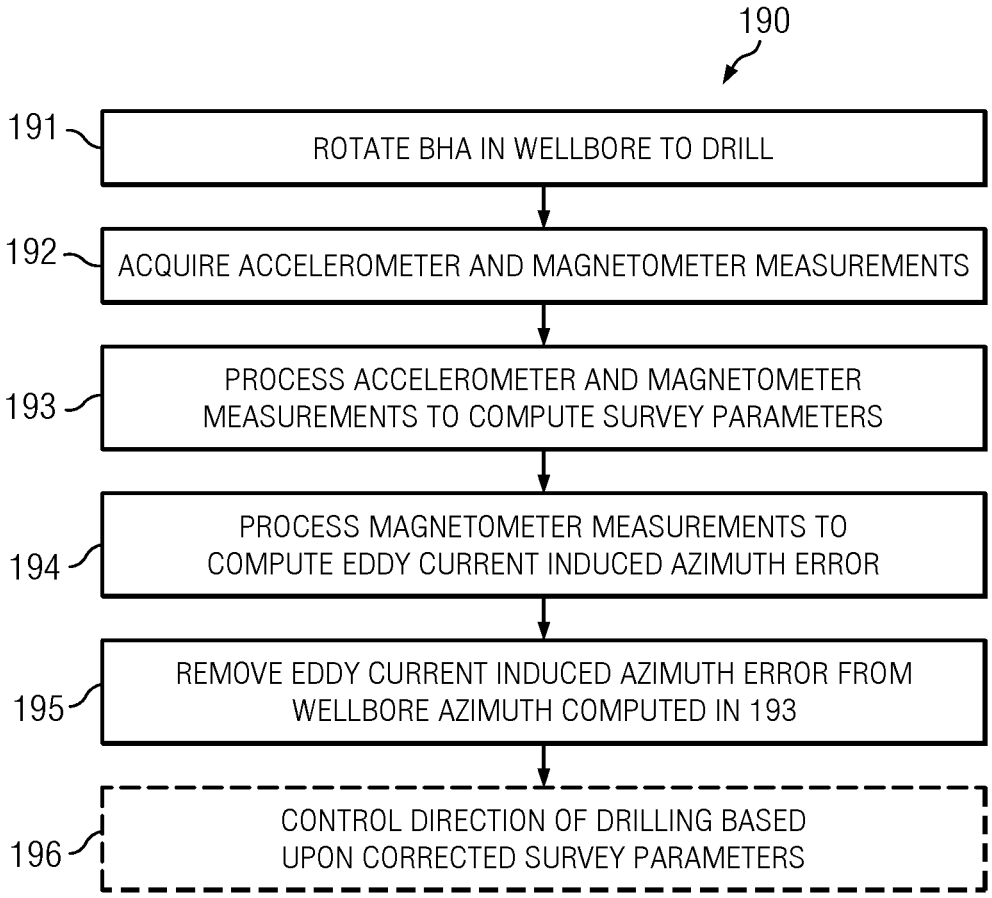
FIG. 9 depicts a flow chart of a method for drilling a subterranean wellbore.

FIG. 9 depicts a flow chart of another example method embodiment 190 for drilling a subterranean wellbore. A bottom hole assembly (e.g., as depicted on FIGS. 1 and 2) is rotated in the wellbore at 191 to drill the well. The bottom hole assembly includes triaxial accelerometers and triaxial magnetometers deployed in a roll-stabilized housing. Triaxial accelerometer and triaxial magnetometer measurements are made at 192 while drilling in 191 (i.e., while rotating the bottom hole assembly in the wellbore to drill the well). The triaxial accelerometer and triaxial magnetometer measurements are processed in 193 to compute wellbore survey parameters including at least the wellbore azimuth. The triaxial magnetometer measurements are further processed in 194 to compute an eddy current induced azimuth error, for example, as described above with respect to FIGS. 7 and 8. This eddy current induced azimuth error is then removed (e.g., via subtraction) from the wellbore azimuth computed in 193 to obtain corrected survey parameters (including a corrected wellbore azimuth) at 195. The corrected survey parameters may then optionally be used for wellbore position and trajectory control at 196 while drilling continues in 191. For example, the direction of drilling in 191 may be adjusted in response to the corrected survey parameters (e.g., by adjusting the position of blades or other actuating components in a rotary steerable tool) to continue drilling along a predetermined path.

With further reference to FIGS. 4-9, various survey parameters may be computed as described above. The computed survey parameters may include, for example, wellbore inclination, wellbore azimuth, gravity toolface, magnetic toolface, and magnetic dip angle. These parameters may be computed using substantially any suitable known mathematical relationships and the corrected accelerometer $A_x'$, $A_y'$, and $A_z'$ and/or magnetometer measurements $B_x'$, $B_y'$, and $B_z'$.

The computed survey parameters may be stored in downhole memory and/or transmitted to the surface, for example, via mud pulse telemetry, electromagnetic telemetry, wired drill pipe, or other telemetry techniques. In some embodiments, the accuracy of the computed parameters may be sufficient such that the drilling operation may forego the use of conventional static surveying techniques. In such embodiments, the wellbore survey may be constructed at the surface based upon the transmitted measurements.

With still further reference to FIGS. 4-9, the computed and/or corrected survey parameters may be used to control and/or change the direction of drilling. For example, in many drilling operations the wellbore (or a portion of the wellbore) is drilled along a drill plan, such as a predetermined direction (e.g., as defined by the wellbore inclination and the wellbore azimuth) or a predetermined curvature. In some embodiments, the computed wellbore inclination and wellbore azimuth may be compared with a desired inclination and azimuth. The drilling direction may be changed, for example, in order to meet the drill plan, or when the difference between the computed and desired direction or curvature exceeds a predetermined threshold. Such a change in drilling direction may be implemented, for example, via actuating steering elements in a rotary steerable tool deployed above the bit. In some embodiments, the survey parameters may be sent directly to an RSS, which processes the survey parameters compared to the drill plan, (e.g., predetermined direction or predetermined curve) and changes drilling direction in order to meet the plan. In some embodiments the survey parameters may be sent to the surface using telemetry so that the survey parameters may be analysed. In view of the survey parameters, drilling parameters (e.g., weight on bit, rotation rate, mud pump rate, etc.) may be modified and/or a downlink may be sent to the RSS to change the drilling direction. In some embodiments both downhole and surface control may be used.

It will be appreciated that the methods described herein may be configured for implementation via one or more controllers deployed downhole (e.g., in a rotary steerable tool or in an MWD tool). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 4-9. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

Although a surveying while drilling method and certain advantages thereof have been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element or feature described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

We claim:

1. A method for drilling a subterranean wellbore, the method comprising:

(a) rotating a drill string in the subterranean wellbore to drill, the drill string including a drill collar, a drill bit, a roll-stabilized housing deployed in the drill collar, and a triaxial accelerometer set, a triaxial magnetometer set, and at least one gyroscopic sensor deployed in the roll-stabilized housing;

(b) causing the triaxial accelerometer set, the triaxial magnetometer set, and the gyroscopic sensor to make corresponding triaxial accelerometer measurements, triaxial magnetometer measurements, and gyroscopic sensor measurements while the drill string is rotating in (a);

(c) combining the triaxial accelerometer measurements and the gyroscopic sensor measurements made in (b) to obtain accelerometer measurements wherein the combining in (c) comprises:

(i) low pass filtering the triaxial accelerometer measurements to obtain filtered accelerometer measurements;

(ii) high pass filtering the gyroscopic sensor measurements to obtain filtered gyroscopic sensor measurements; and (iii) combining the filtered accelerometer measurements and the filtered gyroscopic sensor measurements to obtain accelerometer measurements; and (d) processing the accelerometer measurements obtained in (c) and the triaxial magnetometer measurements made in (b) to compute survey parameters of the subterranean wellbore while drilling in (a), the survey parameters including at least a wellbore azimuth.

2. The method of claim 1, further comprising:

(e) changing a direction of drilling the subterranean wellbore in response to the survey parameters computed in (d).

3. The method of claim 2, wherein:

the drill string further comprises a rotary steerable drilling tool deployed uphole from the drill bit, the roll-stabilized housing being deployed in the rotary steerable drilling tool; and (e) further comprises actuating a steering element on the rotary steerable drilling tool to change the direction of drilling.

4. The method of claim 1, wherein the accelerometer measurements are bandwidth matched with the triaxial magnetometer measurements.

5. The method of claim 1, wherein the combining in (c) comprises summing.

6. The method of claim 1, wherein the combining in (c) comprises:

processing the triaxial accelerometer measurements to obtain accelerometer based toolface angle measurements;

(ii) processing the gyroscopic sensor measurements to obtain gyroscope based toolface angle measurements;

(iii) low pass filtering the accelerometer based toolface angle measurements to obtain filtered accelerometer based toolface angle measurements;

(iv) high pass filtering the gyroscope based toolface angle measurements to obtain filtered gyroscope based toolface angle measurements; and (v) combining the filtered accelerometer based toolface angle measurements and the filtered gyroscope based toolface angle measurements to obtain toolface angle measurements.

7. The method of claim 6, wherein (c) further comprises:

(vi) processing the toolface angle measurements to obtain the accelerometer measurements.

8. The method of claim 7, wherein the accelerometer measurements are computed according to the following equations:

$$A_x' = -\sin(\mathrm{Inc})\cdot\cos(\hat{\theta})$$

$$A_y' = \sin(\mathrm{Inc})\cdot\sin(\hat{\theta})$$

$$A_z' = \cos(\mathrm{Inc})$$

wherein $A_x'$, $A_y'$, and $A_z'$, represent the accelerometer measurements and Inc represents a wellbore inclination.

9. A method for drilling a subterranean wellbore, the method comprising:

(a) rotating a drill string in the subterranean wellbore to drill, the drill string including a drill collar, a drill bit, a roll-stabilized housing deployed in the drill collar, and a triaxial accelerometer set and a triaxial magnetometer set deployed in the roll-stabilized housing;

(b) causing the triaxial accelerometer set and the triaxial magnetometer set to make corresponding triaxial accelerometer measurements and triaxial magnetometer measurements while the drill string is rotating in (a);

(c) processing the triaxial accelerometer measurements and the triaxial magnetometer measurements made in (b) to compute survey parameters of the subterranean wellbore while drilling in (a), the survey parameters including at least a wellbore azimuth;

(d) processing the triaxial magnetometer measurements made in (b) to compute an eddy current induced wellbore azimuth error; and (e) removing the eddy current induced azimuth error computed in (d) from the wellbore azimuth computed in (c) to obtain a corrected wellbore azimuth.

10. The method of claim 9, wherein (d) comprises:

processing accelerometer measurements and magnetometer measurements made during a previous static survey to compute a first toolface offset;

(ii) processing the triaxial accelerometer measurements and the triaxial magnetometer measurements made in (b) to compute a second toolface offset;

(iii) processing a difference between the second toolface offset and the first toolface offset to compute an eddy current induced toolface offset; and (iv) processing the eddy current induced toolface offset to compute the eddy current induced wellbore azimuth error.

11. The method of claim 9, wherein (d) comprises:

processing the triaxial magnetometer measurements made in (b) to determine a relationship between an eddy current induced toolface offset and a rotation rate of the drill collar in (a);

(ii) measuring the rotation rate of the drill collar;

(iii) processing the rotation rate of the drill collar and the relationship determined in (i) to compute an eddy current induced toolface offset; and (iv) processing the eddy current induced toolface offset to compute the eddy current induced wellbore azimuth error.

12. A method for drilling a subterranean wellbore, the method comprising:

(a) rotating a drill string in the subterranean wellbore to drill, the drill string including a drill collar, a drill bit, a roll-stabilized housing deployed in the drill collar, and a triaxial accelerometer set, a triaxial magnetometer set, and at least one gyroscopic sensor deployed in the roll-stabilized housing;

(b) causing the triaxial accelerometer set, the triaxial magnetometer set, and the gyroscopic sensor to make corresponding triaxial accelerometer measurements, triaxial magnetometer measurements, and gyroscopic sensor measurements while the drill string is rotating in (a);

(c) combining the triaxial accelerometer measurements and the gyroscopic sensor measurements made in (b) to obtain accelerometer measurements;

(d) processing the triaxial magnetometer measurements to remove magnetic interference from the magnetometer measurements and to obtain corrected magnetometer measurements wherein the processing comprises:

i) filtering cross-axial components of the triaxial magnetometer measurements to remove cross-axial magnetic interference and obtain filtered cross-axial magnetic field measurements; and (ii) processing the filtered cross-axial magnetic field measurements to remove magnetic interference induced by eddy currents flowing in the rotating drill collar to obtain corrected cross-axial magnetic field measurements; and (e) processing the accelerometer measurements obtained in (c) and the corrected magnetometer measurements obtained in (d) to compute survey parameters of the subterranean wellbore while drilling in (a), the survey parameters including at least a wellbore azimuth.

13. The method of claim 12, further comprising:

changing a direction of drilling the subterranean wellbore in response to the survey parameters computed in (e).

14. The method of claim 13, wherein:

the drill string further comprises a rotary steerable drilling tool deployed uphole from the drill bit, the roll-stabilized housing being deployed in the rotary steerable drilling tool; and (f) further comprises actuating a steering element on the rotary steerable drilling tool to change the direction of drilling.

15. The method of claim 12, wherein the processing in (d) comprises:

processing an axial component of the triaxial magnetometer measurements using multi-station analysis to remove axial magnetic interference and obtain a corrected axial magnetic field measurement.

16. The method of claim 12, wherein the processing in (e) comprises:

processing the accelerometer measurements obtained in (c) and the corrected magnetometer measurements obtained in (d) to compute survey parameters of the subterranean wellbore while drilling in (a), the survey parameters including at least a wellbore azimuth;

(ii) processing the corrected magnetometer measurements obtained in (d) to compute an eddy current induced wellbore azimuth error; and (iii) removing the eddy current induced azimuth error computed in (ii) from the wellbore azimuth computed in (i) to obtain a corrected wellbore azimuth.

17. The method of claim 16, wherein (ii) further comprises processing a rotation rate of the drill collar in (a) to compute the eddy current induced wellbore azimuth error.

18. The method of claim 16, wherein (ii) comprises:

(iia) processing the corrected magnetometer measurements obtained in (d) to determine a relationship between an eddy current induced toolface offset and a rotation rate of the drill collar in (a);

(iib) measuring the rotation rate of the drill collar;

(iic) processing the rotation rate of the drill collar and the relationship determined in (iia) to compute an eddy current induced toolface offset; and (iid) processing the eddy current induced toolface offset to compute the eddy current induced wellbore azimuth error.

19. The method of claim 16, wherein (ii) comprises:

(iia) processing accelerometer and magnetometer measurements made during a previous static survey to compute a first toolface offset;

(iib) processing the accelerometer measurements and the corrected magnetometer measurements to compute a second toolface offset;

(iic) processing a difference between the second toolface offset and the first toolface offset to compute an eddy current induced toolface offset; and (iid) processing the eddy current induced toolface offset to compute the eddy current induced wellbore azimuth error.

20. The method of claim 12, wherein the combining in (c) comprises:

processing the triaxial accelerometer measurements to obtain accelerometer based toolface angle measurements;

(ii) processing the gyroscopic sensor measurements to obtain gyroscope based toolface angle measurements;

(iii) low pass filtering the accelerometer based toolface angle measurements to obtain filtered accelerometer based toolface angle measurements;

(iv) high pass filtering the gyroscope based toolface angle measurements to obtain filtered gyroscope based toolface angle measurements;

(v) combining the filtered accelerometer based toolface angle measurements and the filtered gyroscope based toolface angle measurements to obtain toolface angle measurements; and (vi) processing the toolface angle measurements to obtain the accelerometer measurements.

* * * * *